US007657967B2

(12) United States Patent
Nam et al.

(10) Patent No.: US 7,657,967 B2
(45) Date of Patent: Feb. 9, 2010

(54) BRUSH VIBRATING APPARATUS FOR VACUUM CLEANER

(75) Inventors: Young Sok Nam, Seoul (KR); Seong Ho Cho, Seoul (KR); Myung Keun Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 876 days.

(21) Appl. No.: 11/221,808

(22) Filed: Sep. 9, 2005

(65) Prior Publication Data

US 2006/0143854 A1 Jul. 6, 2006

(30) Foreign Application Priority Data

Dec. 30, 2004 (KR) ..... 10-2004-0116237

(51) Int. Cl.
*A47L 9/04* (2006.01)

(52) U.S. Cl. ..... 15/363; 15/377; 15/381

(58) Field of Classification Search ..... 15/363, 15/377, 381; *A47L 9/04*
See application file for complete search history.

(56) References Cited

U.S. PATENT DOCUMENTS

| | | | | |
|---|---|---|---|---|
| 2,253,289 | A * | 8/1941 | Demaree et al. | 15/364 |
| 2,635,278 | A | 4/1953 | Belknap | |
| 4,020,526 | A | 5/1977 | Johansson | |
| 2003/0037408 | A1 | 2/2003 | Park | |
| 2005/0015922 | A1 * | 1/2005 | Lim et al. | 15/381 |

FOREIGN PATENT DOCUMENTS

| | | | |
|---|---|---|---|
| DE | 24 28 400 | A1 | 1/1976 |
| EP | 0 678 642 | A2 | 10/1995 |
| EP | 1 500 366 | A2 | 1/2005 |
| EP | 1 554 964 | A2 | 7/2005 |
| FR | 1.440.453 | | 5/1966 |
| GB | 2 238 954 | A | 6/1991 |
| KR | 10-2005-0012012 | A | 1/2005 |

* cited by examiner

*Primary Examiner*—David A Redding
(74) *Attorney, Agent, or Firm*—Birch, Stewart, Kolasch & Birch, LLP

(57) ABSTRACT

A brush vibrating apparatus for a vacuum cleaner. The brush vibrating apparatus includes a brush provided in a head portion of the vacuum cleaner and reciprocating and rotating for separating foreign substances from an object to be cleaned; support units provided on the head portion for rotatably supporting the brush; an elastic force supply unit installed between the brush and the support units for supplying elastic force from both sides of a center of the reciprocation of the brush to the center; and a driving force supply unit for supplying driving force, thereby minimizing noise and vibration generated from the reciprocation of the brush, thus allowing the vacuum cleaner to be operated in a smooth and calm state.

16 Claims, 4 Drawing Sheets

BRUSH VIBRATING APPARATUS FOR VACUUM CLEANER

BACKGROUND OF THE INVENTION

1. Field of the Invention

The present invention relates to a vacuum cleaner, and more particularly to a brush vibrating apparatus for a vacuum cleaner, which reciprocates and rotates a brush so that the vacuum cleaner performs a cleaning operation.

2. Description of the Related Art

FIG. 1 is a schematic view illustrating the internal structure of a conventional upright vacuum cleaner.

As shown in FIG. 1, the above vacuum cleaner comprises a main body 10 including an air blower 2 for generating suction force and a dust-collecting bag 4 for collecting foreign substances, such as dust, and a suction unit 20 connected to the main body 10 for sucking the foreign substances together with air.

When the suction force is generated in the main body 10 of the vacuum cleaner, the suction unit 20 sucks foreign substances, such as dust, together with air. Then, the foreign substances are collected by the dust-collecting bag 4, and the air is purified and discharged to the outside. Thereby, the vacuum cleaner performs a cleaning operation.

Particularly, the suction unit 20 includes a suction head 22 connected to the lower part of the main body 10 for forming the external appearance of the vacuum cleaner and provided with an inlet 22*a* formed through the bottom surface thereof for sucking foreign substances together with air, a brush 26 rotatably installed at the inlet 22*a* of the suction head 22 for separating the foreign substances from a floor to be cleaned by the driving force of a driving motor 30, as shown in FIG. 2, a suction nozzle 28 surrounding the circumference of the brush 26 for collecting the foreign substances sucked through the inlet 22*a* of the suction head 22, and a suction hose 29 installed between the suction nozzle 28 and the dust-collecting bag 4 for transmitting the suction force of the air blower 2 to the inlet 22*a* of the suction head 22 and guiding the foreign substances collected in the suction nozzle 28 to the dust-collecting bag 4.

The above vacuum cleaner sucks foreign substances stuck to the floor close to the inlet 22*a* of the suction head 22 by the suction force of the air blower 2, and transfers the sucked foreign substances to the dust-collecting bag 4 through the suction hose 29. Simultaneously, in order to more easily suck the foreign substances accumulated on the floor through the inlet 22*a* of the suction head 22, the vacuum cleaner separates the foreign substances accumulated on or stuck to the floor by rotating the brush 26.

Since the brush 26 of the above conventional vacuum cleaner is continuously rotated by the driving force of the motor 30 to separate the foreign substances from the floor, the foreign substances, such as hairs, may be wound on the brush 26, thereby causing the brush 26 not to separate the foreign substances from the floor, thus deteriorating the cleaning efficiency of the vacuum cleaner.

Further, since brush hairs 26*a* of the conventional vacuum cleaner are arranged on the brush 26 in a spiral structure, dead zones, which do not contact the brush hairs 26*a* when the vacuum cleaner moves to clean, are generated, thereby deteriorating the cleaning function of the vacuum cleaner.

SUMMARY OF THE INVENTION

Therefore, the present invention has been made in view of the above problems, and it is an object of the present invention to provide a brush vibrating apparatus for a vacuum cleaner, which vibrates a brush so as to prevent the winding of foreign substances on the brush or the generation of portions of a floor to be cleaned, not contacting the brush, thereby improving the cleaning efficiency of the vacuum cleaner.

It is another object of the present invention to provide a brush vibrating apparatus for a vacuum cleaner, which provides damping force using an elastic member, such as a torsion bar, when a brush reciprocates and rotates, to minimize noise and vibration generated from the movement of the brush, thereby allowing the vacuum cleaner to be operated in a smooth and calm state.

In accordance with the present invention, the above and other objects can be accomplished by the provision of a brush vibrating apparatus for a vacuum cleaner comprising: a brush provided in a head portion of the vacuum cleaner and reciprocating and rotating for separating foreign substances from an object to be cleaned; support units provided on the head portion for rotatably supporting the brush; an elastic force supply unit installed between the brush and the support units for supplying elastic force from both sides of a center of the reciprocation of the brush to the center; and a driving force supply unit for supplying driving force to reciprocate the brush in a designated angle range.

Preferably, the brush includes a brush tub having a cylindrical structure, and brush hairs protruded from the brush tub such that the brush hairs are arranged in a rectilinear structure in the lengthwise direction of the brush tub.

Further, the support units respectively include fixing members supported to the head portion, and bearings provided between the fixing members and the brush.

Preferably, the driving force supply unit includes a rotary force generating unit; and a link unit connected between the rotary force generating unit and the brush for changing the rotating motion, generated from the rotary force generating unit, to reciprocating motion.

The rotary force generating unit is an electric motor.

In the case that an air blower motor for driving an air blower to generate suction force is installed in the vacuum cleaner, the rotary force generating unit receives driving force from the air blower motor.

Preferably, the link unit includes a rotary link receiving rotary force from the rotary force generating unit; a link lever protruded from the brush in the radial direction; and a connection link eccentrically connected between the link lever and the rotary link.

Further, preferably, the elastic force supply unit is a torsion bar, one end of which is fixed to the head portion, and the other end of which is fixed to the brush to supply torsional elastic force; the link lever is installed on the side surface of the other end of the brush; and the other end of the torsion bar is fixed so that the other end of the torsion bar is rotated together with the rotation of the link lever and the brush.

Otherwise, preferably, the elastic force supply unit is a torsion bar, one end of which is fixed to the head portion, and the other end of which is fixed to the brush to supply torsional elastic force.

More preferably, the torsion bar is extended and passes through the brush, one end of which passes through one end of the brush and is fixed to fixed ends of the support units, and the other end of which is fixed to the other end of the brush so that the other end of the torsion bar is rotated together with the rotation of the brush.

The brush vibrating apparatus of the present invention reciprocates and rotates a brush and causes the brush to contact a floor to be cleaned, so as to prevent the winding of foreign substances on the brush or the generation of portions of the floor not contacting the brush, thereby improving the cleaning efficiency of the vacuum cleaner.

Further, the brush vibrating apparatus of the present invention provides damping force using an elastic member, such as a torsion bar, when the brush reciprocates and rotates, to minimize noise and vibration generated from the reciprocation of the brush, thereby allowing the vacuum cleaner to be operated in a smooth and calm state.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the annexed drawings.

Although there are plural embodiments of a brush vibrating apparatus for a vacuum cleaner in accordance with the present invention, the most preferred embodiment will be described as follows. In the following description of the present invention, a detailed description of known configurations incorporated herein will be omitted when it may make the subject matter of the present invention rather unclear.

The brush vibrating apparatus of the present invention is installed at a suction head of a suction unit of a vacuum cleaner. That is, in an upright vacuum cleaner, the brush vibrating apparatus is provided at the lower end of the suction unit contacting a floor to be cleaned, and in a cylinder floor-type vacuum cleaner, the brush vibrating apparatus is provided in a head portion connected to a main body by a suction pipe.

Now, the brush vibrating apparatus of the present invention will be described in detail with reference to FIGS. 3 to 6.

Figure 3:
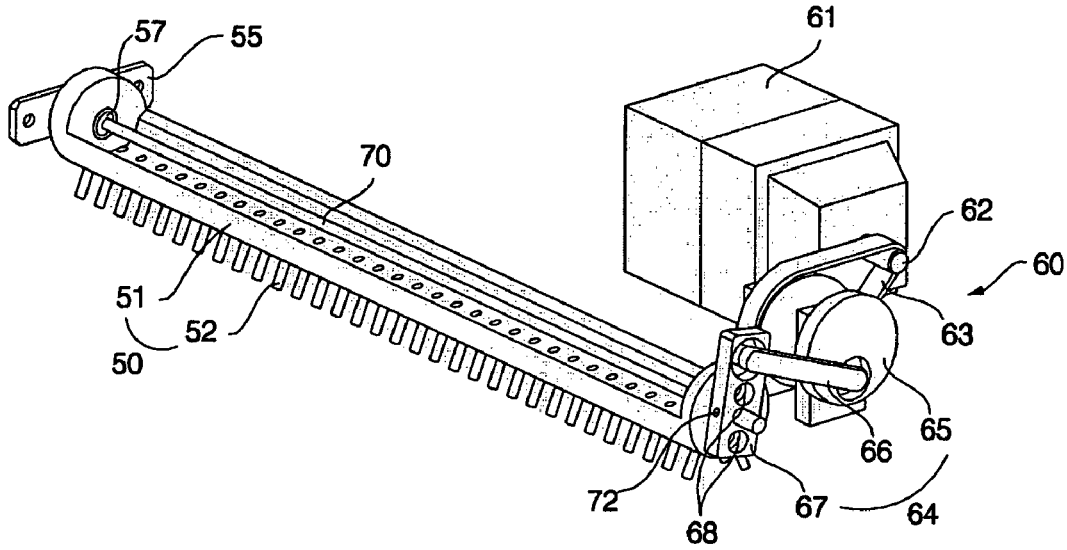
FIG. 3 is a perspective view of a brush vibrating apparatus for a vacuum cleaner in accordance with the present invention.
Figure 4:
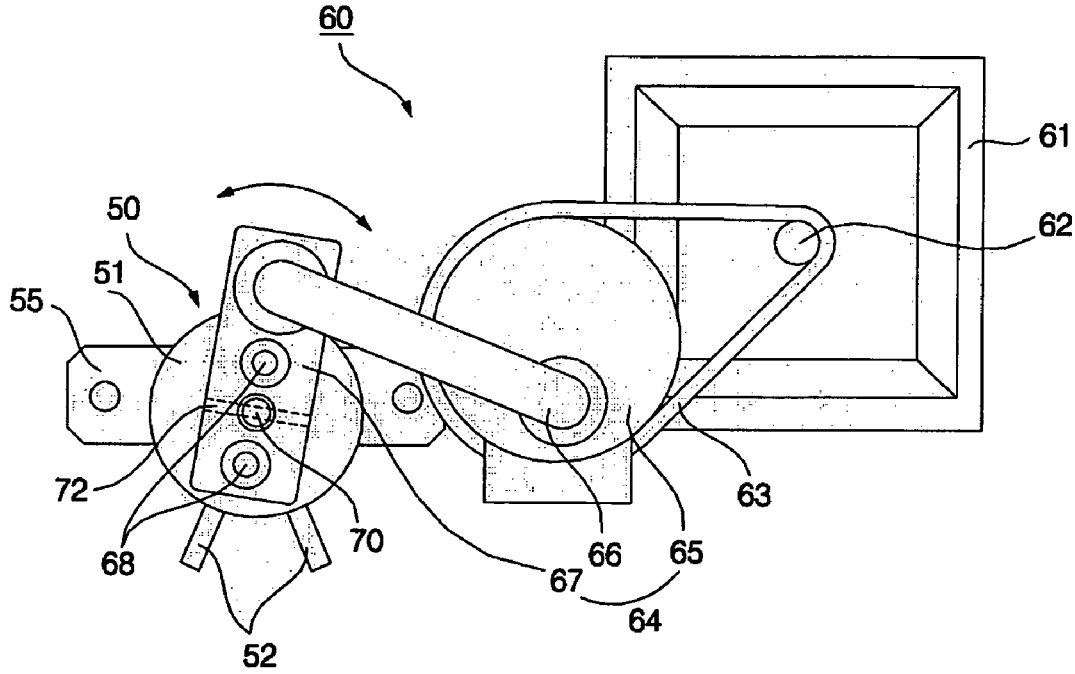
FIG. 4 is a side view of the brush vibrating apparatus in accordance with the present invention.
Figure 5:
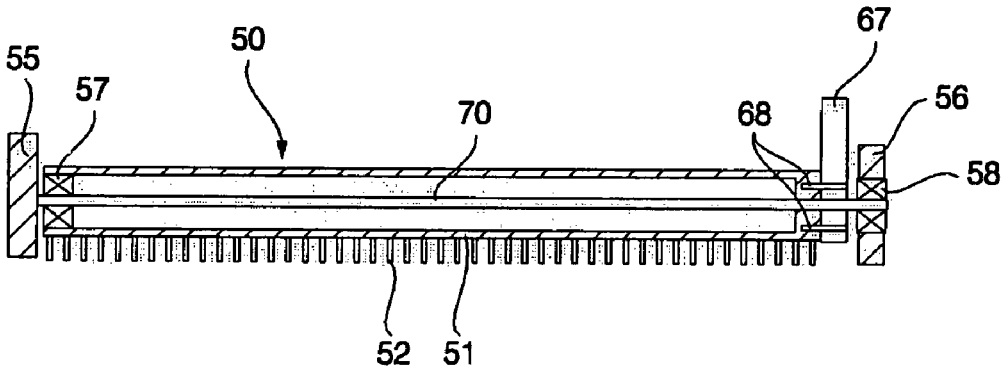
FIG. 5 is a schematic view illustrating the front internal structure of the brush vibrating apparatus in accordance with the present invention.

FIG. 3 is a perspective view of the brush vibrating apparatus, FIG. 4 is a side view of the brush vibrating apparatus, and FIG. 5 is a schematic view illustrating the front internal structure of the brush vibrating apparatus.

As shown in FIGS. 3 to 5, a brush 50 reciprocating and rotating for separating foreign substances from the floor to be cleaned is provided in a head portion of the vacuum cleaner.

The brush 50 includes a brush tub 51 having a cylindrical structure and extended in the crosswise direction, and brush hairs 52 rectilinearly arranged on the brush tub 51 in the lengthwise direction of the brush tub 51 and contacting an object to be cleaned. Here, the brush hairs 52 may be arranged in plural lines. This embodiment describes the brush hairs arranged in two lines.

Support units for rotatably supporting the brush 50 to the head portion of the vacuum cleaner are respectively provided at both sides of the brush 50.

With reference to FIG. 5, the support units respectively include fixing members 55 and 56 positioned at both sides of the brush 50 and supported to the head portion, and bearings 57 and 58 respectively installed between the fixing members 55 and 56 and the brush 60 for rotatably supporting the brush 50.

As shown in FIG. 5, the left bearing 57 is installed on a torsion bar 70, which will be described later, to rotatably support the brush 50, and the right bearing 58 is installed on the right fixing member 56 to rotatably supporting one end of the torsion bar 70. Here, the right portion of the brush 50 is integrally fixed to the torsion bar 70 so that the brush 50 and the torsion bar 70 are simultaneously rotated. This rotation will be described later.

A driving force supply unit 60 supplies driving force for reciprocating the brush 50 in a designated angle range.

The driving force supply unit 60 includes a rotary force generating unit, such as an electric motor 61 for generating rotary force, and a link unit 64 connected between the rotary force generating unit and the brush 50 for changing the rotating motion, generated from the rotary force generating unit, to the reciprocating motion.

In this embodiment, the rotary force generating unit is the electric motor 61. The electric motor 61 may be applied to both the cylinder floor-type vacuum cleaner and the upright vacuum cleaner.

Figure 1:
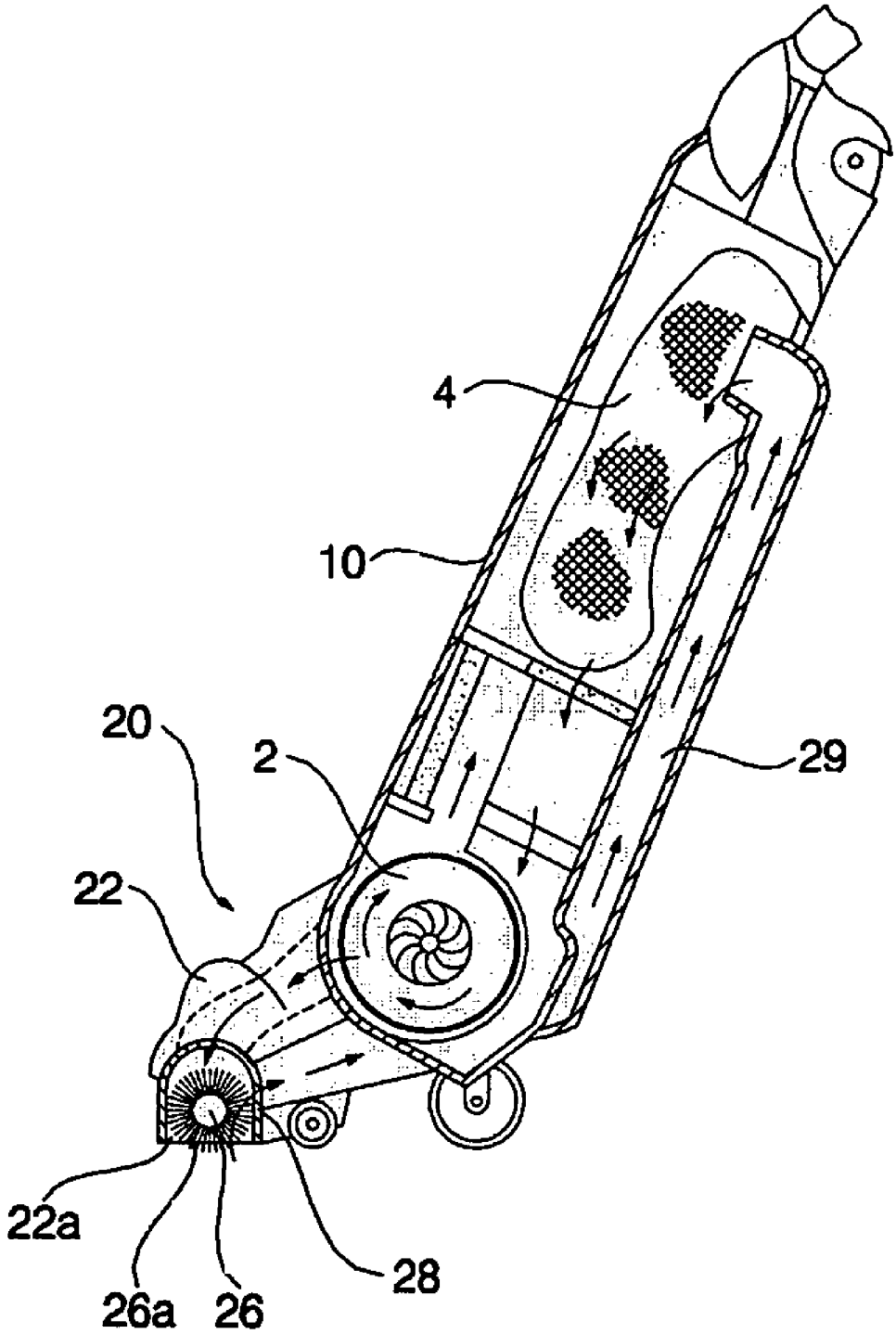
FIG. 1 (Prior Art)
FIG. 1 is a schematic view illustrating the internal structure of a conventional vacuum cleaner.
Figure 2:
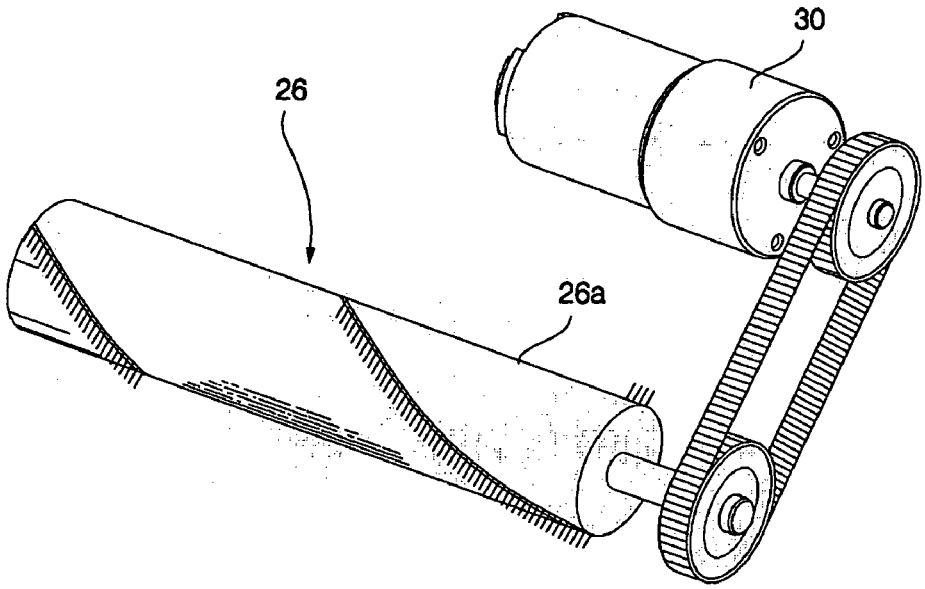
FIG. 2 (Prior Art)
FIG. 2 is a schematic view of a brush-operating unit provided in the conventional vacuum cleaner.

Particularly, in the upright vacuum cleaner, as shown in FIG. 1, since the main body 10 and the suction unit 20 including the head portion are integrally formed, the motor (not shown) driving the air blower 2 for generating suction force provides the rotary force. That is, the rotary force is transmitted from the motor of the air blower 2 through power transmission means, such as a belt.

The link unit 64, which receives the rotary force through the electric motor 61, includes a rotary link 65 for reducing the rotary force of the electric motor 61 and transmitting the reduced rotary force, a link lever 67 protruded from the brush 50 in the radial direction, and a connection link 66 connected between the link lever 67 and the rotary link 65.

The rotary link 65 has the structure of a crankshaft, and is connected to a shaft 62 of the electric motor 61 by a belt 63 for receiving the transmitted driving force. Further, the connection link 66 is connected to a position of the rotary link 65, eccentrically from the rotary center of the rotary link 65. Although this embodiment describes the configuration in which the rotary link 65 receives the rotary force from the electric motor 61 through the belt 63, the rotary link 65 may be installed directly on the shaft 62 of the electric motor 61 according to design conditions.

The connection link 66 has the structure of a rectilinear rod, and both ends of the connection link 66 are respectively connected to the rotary link 65 and the link lever 67 such that the ends of the connection link 66 are freely rotatable.

The link lever 67 is fixed to the side surface of the brush 50 by at least two fixing members 68, and the torsion bar 70 passes through a space between the two fixing members 68 and is fixed thereto.

An elastic force supply unit supplies elastic force from both sides to the center of the reciprocating motion of the brush 50. That is, when the brush 50 reciprocates right and left in the designated angle range by means of the driving force of the electric motor 61, the moving direction of the brush 50 is changed at a point where the speed of the brush 50 is zero, thereby increasing the generation of noise and vibration due to impact. The elastic force supply unit supplies elastic force to damp the above impact and facilitate the smooth reciprocating motion of the brush 50.

Although the elastic force supply unit may include various elements, such as coil springs, plate springs, and rubber members, positioned between the support units 55 and 56, serving as fixed ends, and the brush 50, serving as a rotating body, this embodiment describes the configuration of the elastic force supply unit using the torsion bar 70.

The torsion bar 70 passes through the inside of the brush 50 in the lengthwise direction. The left end of the torsion bar 70 passes through the end of the brush 50, and is fixed to the left support member 55. Further, the right end of the torsion bar 70 is fixed to the brush 50 and the link lever 67, and is rotatably supported by the bearing 58.

That is, since the right end of the torsion bar 70 is fixed to the link lever 67 and the brush 70, serving as rotating bodies, under the condition that the left end of the torsion bar 70 is stationary, the torsion bar 70 supplies torsional elastic force.

Preferably, the right end of the torsion bar 70 is fixed to the link lever 67 by a pin 72, as shown in FIG. 4, so that the right end of the torsion bar 70 moves together with the movement of the link lever 67.

Alternately, the link layer 67 and the torsion bar 70 may be fixed to each other and the torsion bar 70 and the brush 50 may be fixed to each other so that the moving force of the link lever 67 is not directly transmitted to the brush 50 and the torsion bar 70 is twisted to drive the brush 50.

Hereinafter, the function of the above brush vibrating apparatus of the present invention will be described in detail.

When the electric motor 61 is driven, the rotary link 65 connected to the shaft 62 of the electric motor 61 by the belt 63 rotates, and the link lever 67 connected to the rotary link 65 by the connection link 66 reciprocates in a designated angle range. Here, the brush 50, to which the link lever 67 is fixed, reciprocates in the designated angle range together with the reciprocation of the link lever 67.

Since the brush 50 continuously reciprocates and vibrates when the electric motor 61 rotates at an angle of 360 degrees, the brush hairs 52 of the brush 50 contact the floor to be cleaned, and perform translational motion, thereby being capable of separating foreign substances from the floor.

Since the torsion bar 70 is installed in the brush 50, the torsion bar 70 is twisted to retain elastic force when the brush 50 is rotated right and left from the rotary center. When the moving direction of the brush 50 is changed, the brush 50 smoothly reciprocates in the reverse direction by the restoring elastic force of the torsion bar 70 as well as the driving force of the electric motor 61.

When the motion of the brush 50 is changed in the reverse direction, the torsion bar 70 serves as a damper to absorb impact generated due to the change of the moving direction of the brush 50, thereby reducing the generation of noise and vibration due to the continuous reciprocating motion.

Figure 6:
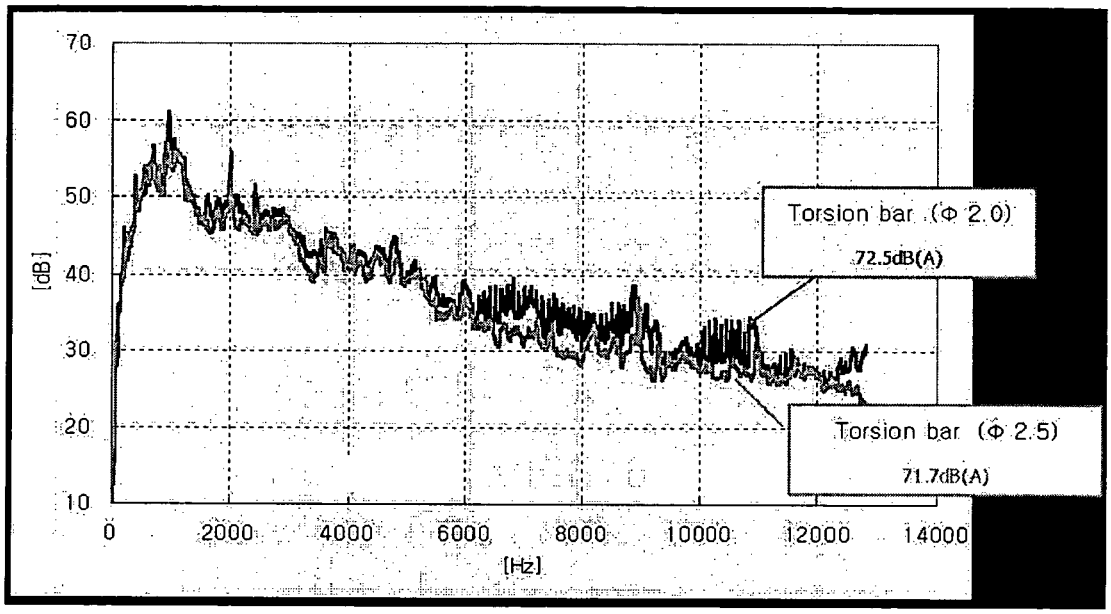
FIG. 6 is a graph illustrating a variation in the generation of noise according to a vibration in the diameter of a torsion bar of the brush vibration apparatus in accordance with the present invention.

For reference, FIG. 6 is a graph illustrating a variation in the generation of noise according to a vibration in the diameter of the torsion bar in comparison with the rotational speed of the electric motor. When the torsion bar 70 has a diameter of 2.0 mm, noise of 72.7 dB was generated at a designated frequency region, and when the torsion bar 70 has a diameter of 2.5 mm, noise of 71.5 dB, which is lower than the above noise, was generated at the designated frequency region.

Further, since the brush 50 starts its initial motion at a position, in which the elastic force of the torsion bar 70 is zero, i.e., a central point of the right and left reciprocating motion, the brush 50 can start precisely its motion at an initial setting position.

As apparent from the above description, the present invention provides a brush vibrating apparatus for a vacuum cleaner, which reciprocates and rotates a brush and causes the brush to contact a floor to be cleaned, so as to prevent the winding of foreign substances on the brush or the generation of portions of the floor not contacting the brush, thereby improving the cleaning efficiency of the vacuum cleaner.

Further, the brush vibrating apparatus of the present invention provides damping force using an elastic member, such as a torsion bar, when the brush reciprocates and rotates, to minimize noise and vibration generated from the reciprocation of the brush, thereby allowing the vacuum cleaner to be operated in a smooth and calm state.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A brush vibrating apparatus for a vacuum cleaner comprising:

a brush provided in a head portion of the vacuum cleaner and reciprocating and rotating for separating foreign substances from an object to be cleaned, the brush including a brush tub having a hollow therein and brush hairs;

a pair of support units fixed to both sides of the head portion;

a torsion bar configured to supply elastic force to the brush; and a driving force supply unit for supplying driving force to reciprocate the brush in a designated angle range, wherein the torsion bar passes through the brush tub such that the torsion bar is rotatably connected to one side of the brush tub and is fixed to the other side of the brush tub, and wherein one end of the torsion bar is fixed to one support unit and the other end of the torsion bar is rotatably connected to the other support unit.

2. The brush vibrating apparatus as set forth in claim 1, wherein the brush tub is formed in a cylindrical structure, and the brush hairs are protruded from the brush tub such that the brush hairs are arranged in a rectilinear structure in the lengthwise direction of the brush tub.

3. The brush vibrating apparatus as set forth in claim 1, wherein the support units respectively include fixing members supported to the head portion, and bearings provided between the fixing members and the brush.

4. The brush vibrating apparatus as set forth in claim 1, wherein the driving force supply unit includes:

a rotary force generating unit; and a link unit connected between the rotary force generating unit and the brush for changing the rotating motion, generated from the rotary force generating unit, to reciprocating motion.

5. The brush vibrating apparatus as set forth in claim 4, wherein the rotary force generating unit is an electric motor.

6. The brush vibrating apparatus as set forth in claim 4, wherein:

an air blower motor for driving an air blower to generate suction force is installed in the vacuum cleaner; and the rotary force generating unit receives driving force from the air blower motor.

7. The brush vibrating apparatus as set forth in claim 4, wherein the link unit includes:

a rotary link receiving rotary force from the rotary force generating unit;

a link lever protruded from the brush in the radial direction; and a connection link eccentrically connected between the link lever and the rotary link.

8. The brush vibrating apparatus as set forth in claim 7, wherein the link lever is fixed to the side surface of the brush.

9. A brush vibrating apparatus for a vacuum cleaner comprising:

a brush provided in a head portion of the vacuum cleaner and reciprocating and rotating for separating foreign substances from an object to be cleaned;

support units provided on the head portion for rotatably supporting the brush;

a torsion bar, one end of which is fixed to the head portion, and the other end of which is fixed to the brush, for supplying torsional elastic force from both sides of a center of the reciprocation of the brush to the center;

a rotary force generating unit for generating driving force; and a link unit connected between the rotary force generating unit and the brush for changing the rotating motion, generated from the rotary force generating unit, to reciprocating motion so that the brush reciprocates in a designated angle range, wherein the link unit includes:

a rotary link receiving rotary force from the rotary force generating unit;

a link lever protruded from the brush in the radial direction; and a connection link eccentrically connected between the link lever and the rotary link, and wherein the link lever is fixed to the side surface of one end of the brush; and the other end of the torsion bar is fixed to the link lever such that the other end of the torsion bar is rotated together with the rotation of the link lever and the brush.

10. The brush vibrating apparatus as set forth in claim 9, wherein brush hairs provided on the brush are arranged in a rectilinear structure in the lengthwise direction of the brush.

11. The brush vibrating apparatus as set forth in claim 9, wherein the rotary force generating unit is an electric motor.

12. The brush vibrating apparatus as set forth in claim 9, wherein:

an air blower motor for driving an air blower to generate suction force is installed in the vacuum cleaner; and the rotary force generating unit receives driving force from the air blower motor.

13. A brush vibrating apparatus for a vacuum cleaner comprising:

a brush provided in a head portion of the vacuum cleaner, reciprocating and rotating for separating foreign substances from an object to be cleaned, and including brush hairs arranged in a rectilinear structure;

a pair of fixing members fixed to both sides of the head portion;

a torsion bar installed to pass through the brush, one end of which is fixed to one fixing member, and the other end of which is rotatably connected to the other fixing member, for supplying torsional elastic force from both sides of a center of the reciprocation of the brush to the center;

a rotary force generating unit for generating driving force; and a link unit connected between the rotary force generating unit and the brush for changing the rotating motion, generated from the rotary force generating unit, to reciprocating motion so that the brush reciprocates in a designated angle range.

14. The brush vibrating apparatus as set forth in claim 13, wherein the rotary force generating unit is an electric motor.

15. The brush vibrating apparatus as set forth in claim 13, wherein the link unit includes:

a rotary link receiving rotary force from the rotary force generating unit;

a link lever protruded from the brush in the radial direction; and a connection link eccentrically connected between the link lever and the rotary link.

16. The brush vibrating apparatus as set forth in claim 15, wherein:

the link lever is fixed to the side surface of the other end of the brush; and the other end of the torsion bar is fixed to the link lever such that the other end of the torsion bar is rotated together with the rotation of the link lever and the brush.

* * * * *